US006764322B1

(12) United States Patent
Yu

(10) Patent No.: US 6,764,322 B1
(45) Date of Patent: Jul. 20, 2004

(54) POWER PLUG RECEPTACLE HAVING SAFETY COVER

(76) Inventor: Tsung-I Yu, No. 209, Sec. 3, County Boulevard, Pan Chiao City, Taipei (TW)

( * ) Notice: Subject to any disclaimer, the term of this patent is extended or adjusted under 35 U.S.C. 154(b) by 0 days.

(21) Appl. No.: 10/682,206

(22) Filed: Oct. 10, 2003

(51) Int. Cl.[7] ..... H01R 13/44

(52) U.S. Cl. ..... 439/137; 439/106; 439/134; 439/143; 439/536

(58) Field of Search ..... 439/134–137, 439/106, 143, 536

(56) References Cited

U.S. PATENT DOCUMENTS 4,743,206 A * 5/1988 Imhoff ..... 439/137
5,066,238 A * 11/1991 Shieh ..... 439/139
5,096,432 A * 3/1992 Cullen et al. ..... 439/139
6,537,089 B1 * 3/2003 Montague ..... 439/145
6,599,141 B2 * 7/2003 Hambley et al. ..... 439/139
6,602,081 B1 * 8/2003 Wang ..... 439/145

* cited by examiner

*Primary Examiner*—Truc Nguyen
(74) *Attorney, Agent, or Firm*—Bacon & Thomas PLLC

(57) ABSTRACT

A power plug receptacle having a safety cover comprises a plurality of sockets each provided with a rotary safety cover. A socket and a safety cover are coupled through inserting a pivot post into a pivot hole and engaging a guiding pin into a guiding slot. A torsional spring provided within the socket resiliently ejects the safety cover into a position where the socket holes and the safety cover holes are misaligned. Therefore, the socket is automatically sealed, achieving the protective functions against foreign intrusion.

7 Claims, 5 Drawing Sheets

POWER PLUG RECEPTACLE HAVING SAFETY COVER

BACKGROUND OF THE INVENTION (a) Field of the Invention

The present invention relates to power plug receptacles having safety features, and more particularly to a power plug receptacle having a safety cover, wherein a socket is coupled with a rotary safety cover that is resiliently ejected by a spring to cover the holes of the socket when not being used. The safety cover thus can prevent the socket from foreign object intrusion.

(b) Description of the Prior Art

The power plug receptacles of the prior art, installed on a wall or being a part of a power cord, have a number of sockets each having two or three holes for receiving a power plug. The sockets of a conventional power plug receptacle are usually uncovered, which are susceptible to foreign object insertion by inadvertent children and may thereby cause electric shock hazard. It is a further disadvantage that dust and liquid drops would get into the sockets to cause erosion problem.

A commonly seen safety feature for power plug receptacles is a cover plate having a plurality of upright posts that could be coupled with the holes of a socket. By attaching the plate to a socket, the protective functions against foreign intrusion and dust collection are indeed achieved. It is however disadvantageous in that the cover plate can be easily taken off children, and in that the cover plate has to be removed from the receptacle when the associated socket is in use. People need to take extra effort to keep the removed cover plates.

SUMMARY OF THE INVENTION

Accordingly, the primary objective of the present invention is to provide a power plug receptacle having a safety cover, wherein at least a pivot hole, a guiding slot, a locking post and a torsional spring are provided within a socket and are coupled with corresponding members on the safety cover, by which the safety cover is resiliently ejected by the spring into a position where the holes of the socket and the holes of the safety cover are misaligned. Therefore, the socket is automatically sealed. To use the socket, the safety cover is rotated about an axis to have the socket holes and the cover holes suitably aligned for receiving a power plug. This mechanism achieves the protective functions against foreign intrusion and dust collection, and further solves the problem of removed safety cover keeping.

The various objects and advantages of the present invention will be more readily understood from the following detailed description when read in conjunction with the appended drawings.

DETAILED DESCRIPTION OF THE PREFERRED EMBODIMENTS

Figure 1:
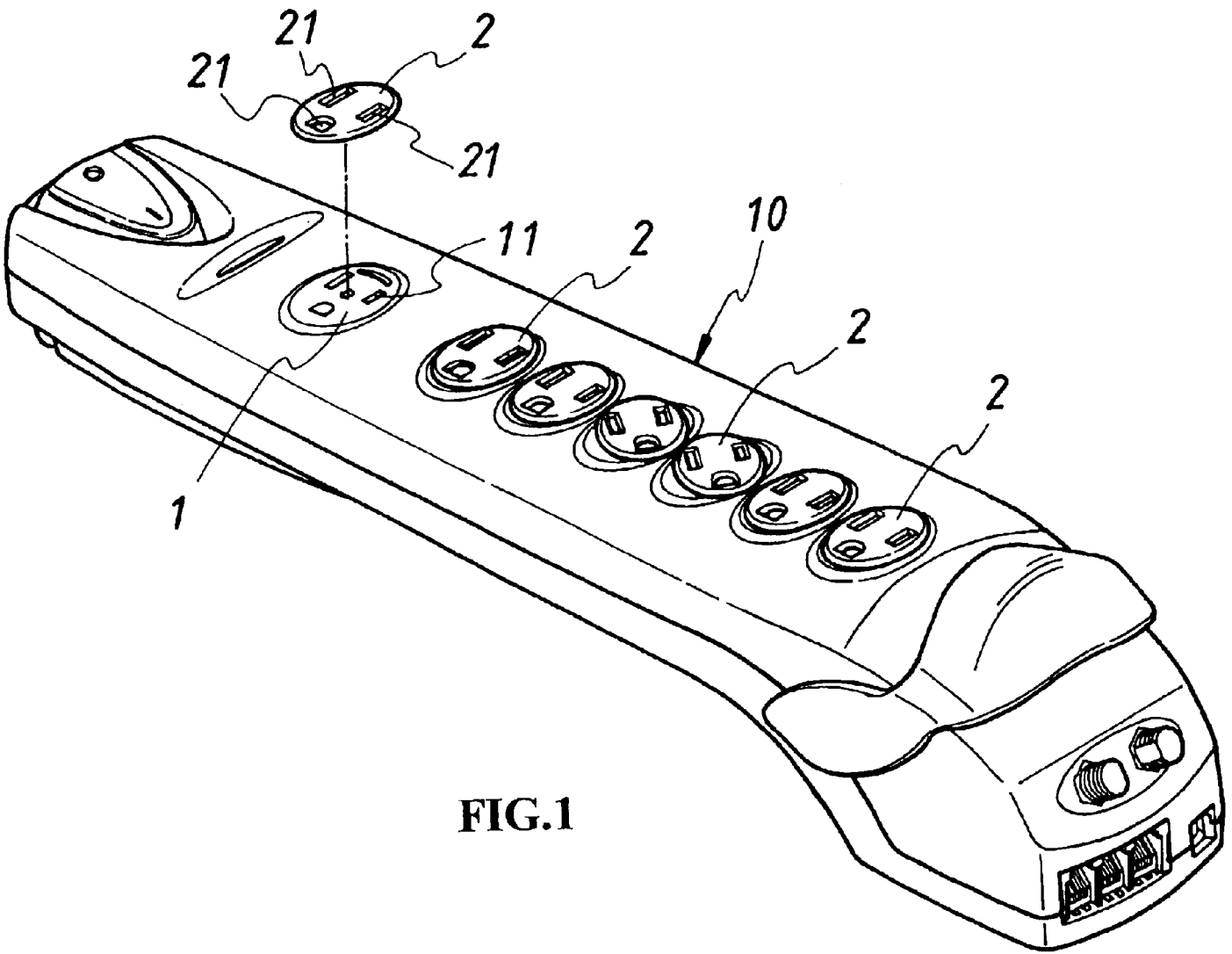
FIG. 1 is a perspective view of a preferred embodiment according to the present invention used in a power cord.
Figure 2:
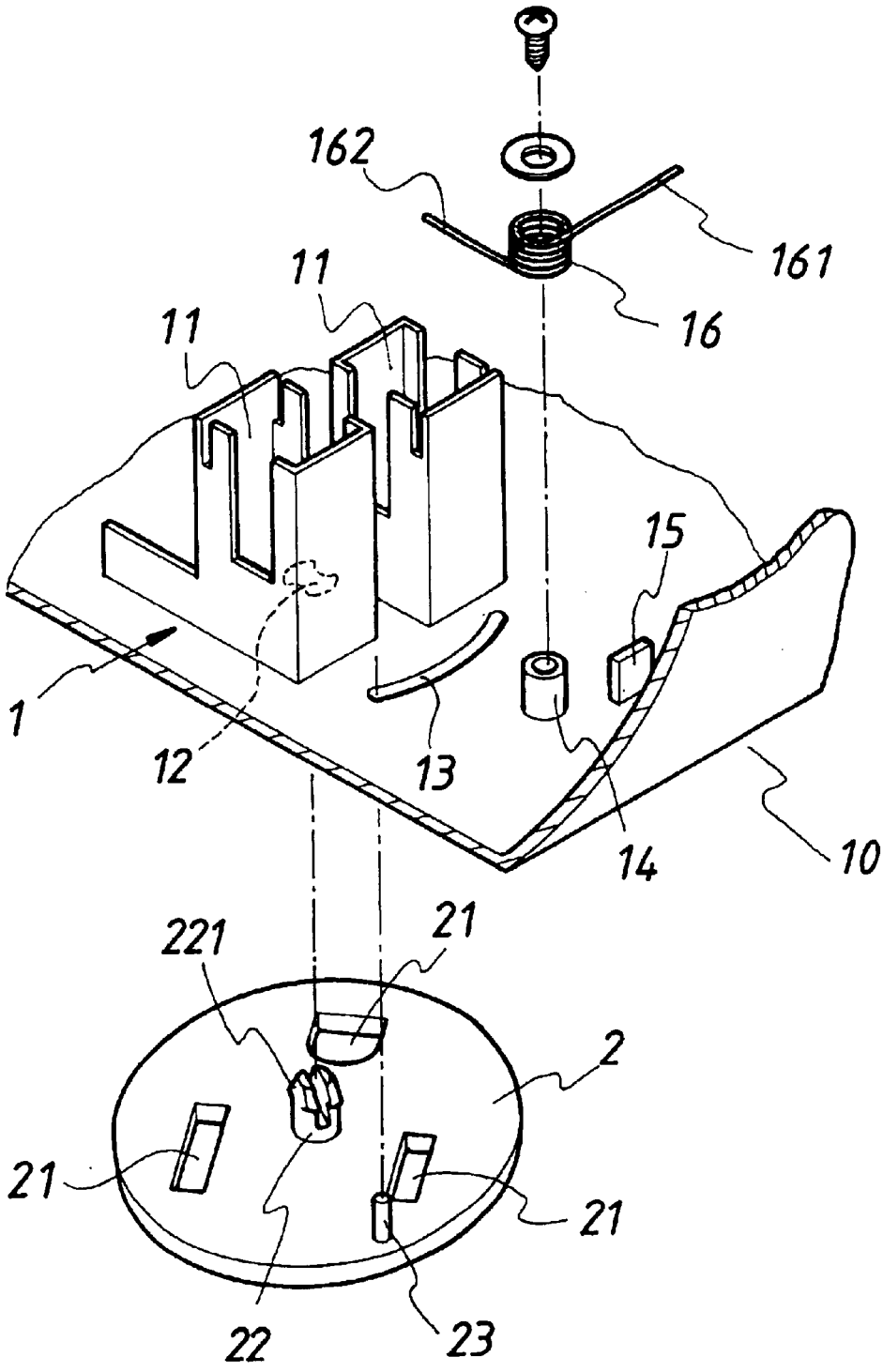
FIG. 2 is an exploded perspective view of local portion of the present invention.
Figure 3:
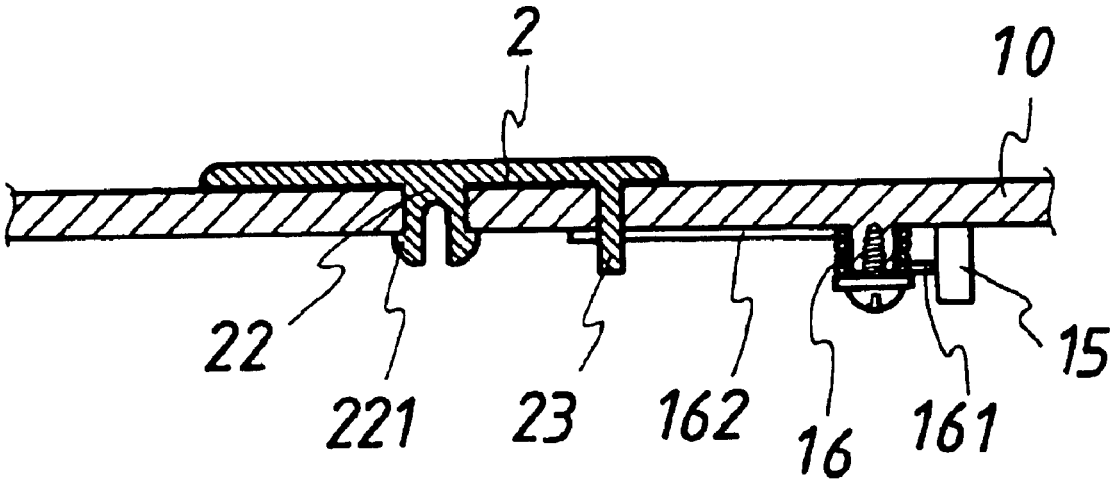
FIG. 3 is a cross-sectional lateral view of local portion of the present invention.

Referring to FIGS. 1 and 3, a power plug receptacle having a safety cover according to the present invention comprises a power plug receptacle 10 having a sockets 1, which has a rotary safety cover 2.

The socket 1 is provided with conventional mechanisms, such as metallic conducting plates, for electrically connecting an inserted power plug. And the inlet of the socker 1 can be chosen from a two-hole type, a three-hole type and other conventional types. Since the above-mentioned mechanisms belong to the prior art, we do not go further in that respect. The present invention is characterized by an additional mechanism provided to the socket 1. This mechanism comprises a pivot hole 12, a guiding slot 13, a locking post 14, a stopping plate 15 and a torsional spring 16. The pivot hole 12 and the guiding slot 13 are formed adjacent to the socker 1 on chosen locations. The inner wall of the socker 1 is provided with a locking post 14 and a stopping plate 15, so as to mount a torsional spring 16 on the locking post 14 and to block a first extending arm 161 of the torsional spring 16 against the stopping plate 15. As an alternative, a point on the inner wall of the associated socket may also retain the first extending arm 161.

Figure 4:
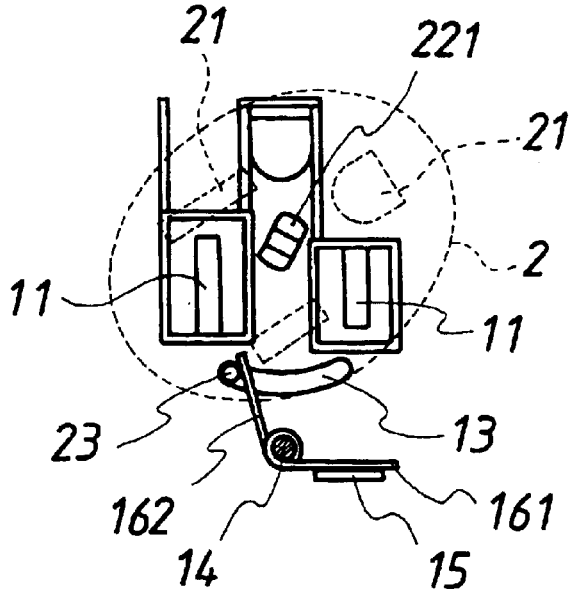
FIG. 4 is a bottom view of the present invention in which a torsional spring blocks against a guiding pin when the safety cover is misaligned with the socket.
Figure 5:
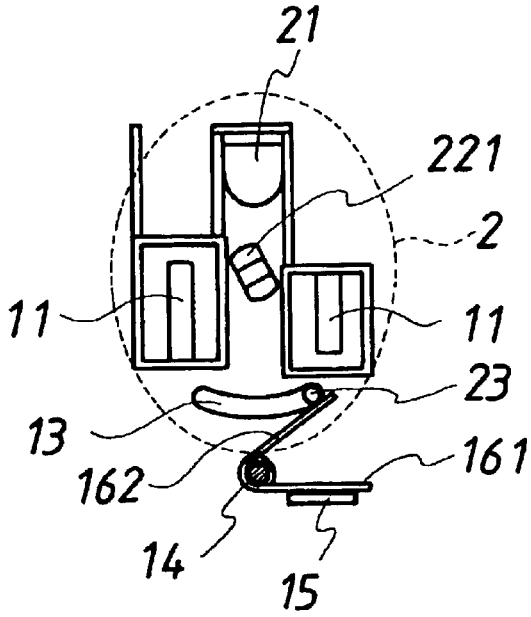
FIG. 5 is a bottom view of the present invention in which a torsional spring is pressed inwardly by a guiding pin when the safety cover is aligned with the socket.

The safety cover 2 is a plate provided with a plurality of insertion holes 21, a pivot post 22 and a guiding pin 23, respectively corresponding to the insertion hole 11, the pivot hole 12 and the guiding slot 13. The pivot post 22 is inserted into the pivot hole 12 to form a pivotal connection. The guiding pin 23 goes through the guiding slot 13 on the corresponding socket so as to be supported by a second extending arm 162 of the torsional spring 16, as shown in FIG. 4. As the guiding pin 23 moves along the guiding slot 13, the torsional spring 16 is twisted and the two extending arms thereof undergo a relative angular displacement, as shown in FIG. 5.

Figure 6:
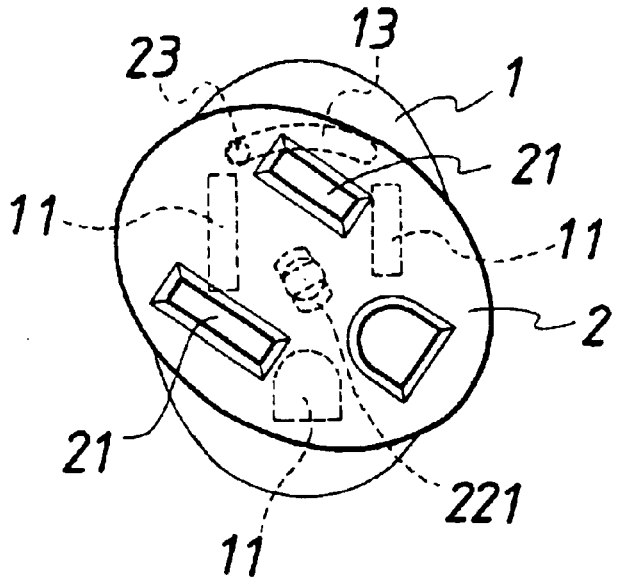
FIG. 6 is a top view of the present invention when the safety cover is misaligned with the socket so as to seal the socket.
Figure 7:
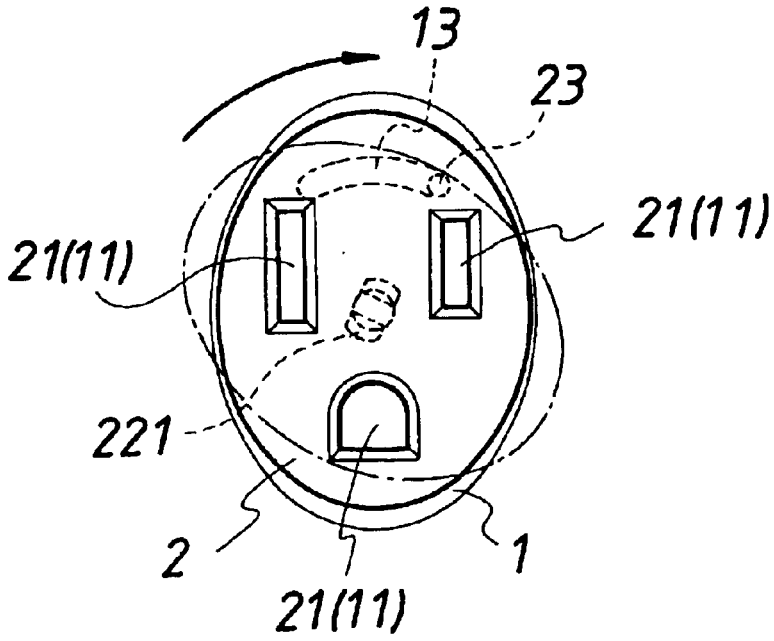
FIG. 7 is a top view of the present invention when the safety cover is aligned with the socket so as to open the socket.

Because of the restoring force of the torsional spring 16 exerted on the guiding pin 23 by the second extending arm 162, a set of socker 1 and safety cover 2 as coupled by the above-mentioned mechanism before a power plug is inserted is in a configuration in which the insertion holes 11 of the socker 1 and the insertion holes 21 of the safety cover 2 are misaligned, as shown in FIG. 6. Therefore, the socket is prevented from foreign object insertion and dust collection. To use the socket 1, the rotary safety cover 2 is rotated to have the insertion holes 11 and the insertion holes 21 suitably aligned, as shown in FIG. 7 for receiving a power plug.

In this preferred embodiment, the guiding slot 13 of the socket 1 takes the shape of a gentle arc for the guiding pin 23 of the corresponding safety cover 2 to slide smoothly therein. Instead of using a stopping plate 15, the inner wall of the socker 1 can also block the first extending arm 161 of a torsional spring 16 that is mounted within a socket 1; this provides a sufficient retaining effect. Furthermore, the pivot post 22 is an extended member 221 of a safety cover 2 and is provided with a slot in the longitudinal direction. And, thereby, the pivot post 22 can be easily inserted into a pivot hole 12 of a socker 1 and then forms a stable pivotal connection.

The preferred embodiment is the present invention applied to the power plug receptacle of a power cord. The same invention can be applied to power socket of any type.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A power plug receptacle having a safety cover comprising:

a socket provided with a plurality of insertion holes, a pivot hole and a guiding slot on predetermined locations thereon, the socket further including a torsional spring secured on an inner wall thereof, a first extending arm of the torsional spring being blocked against a point on the inner wall; and a safety cover provided with a plurality of insertion holes, a pivot post and a guiding pin, respectively corresponding to the insertion holes, the pivot hole and the guiding slot on the socket, the pivot post being inserted into the pivot hole to form a pivotal connection, the guiding pin being inserted through the guiding slot and being retained by a second extending arm of the torsional spring, the guiding pin be capable of moving a distance along the guiding slot by which the torsional spring is twisted;

the socket coupled with the safety cover being in a normal configuration in which the safety cover is resiliently ejected by the spring to have the insertion holes of the socket and the insertion holes of the safety cover misaligned, the socket thereby being automatically sealed and protected from foreign object intrusion, the safety cover being capable of being pushed around in a way that the insertion holes of the socket and the insertion holes of the safety cover are aligned for receiving a power plug.

2. The power plug receptacle having a safety cover of claim 1, wherein the inner wall of the socket is provided with a locking post for substantially mounting the torsional spring.

3. The power plug receptacle having a safety cover of claim 1, wherein the inner wall of the socket is provided with a stopping plate for retaining the first extending arm of the torsional spring.

4. The power plug receptacle having a safety cover of claim 1, wherein the guiding slot on the socket is a gently arced, elongated slot.

5. The power plug receptacle having a safety cover of claim 1, wherein the pivot post of the safety cover is an extended member provided with a slot at a free end thereof and extending downward longitudinally.

6. The power plug receptacle having a safety cover of claim 1, wherein the insertion holes of the socket is of two-hole type.

7. The power plug receptacle having a safety cover of claim 1, wherein the insertion holes of the socket is of multiple-hole type.

* * * * *